US009443416B2

(12) United States Patent
Kalivas et al.

(10) Patent No.: US 9,443,416 B2
(45) **Date of Patent: *Sep. 13, 2016**

(54) FIRE ALARM POWER LINE CARRIER COM-SYSTEM

(71) Applicant: Christopher George Kalivas, Patchogue, NY (US)

(72) Inventors: Christopher George Kalivas, Patchogue, NY (US); Steven Perry Apelman, Centereach, NY (US)

(73) Assignee: Chris Kalivas, Patchogue, NY (US)

( * ) Notice: Subject to any disclaimer, the term of this patent is extended or adjusted under 35 U.S.C. 154(b) by 46 days.

This patent is subject to a terminal disclaimer.

(21) Appl. No.: 14/497,322

(22) Filed: Sep. 26, 2014

(65) Prior Publication Data

US 2015/0130610 A1 May 14, 2015

Related U.S. Application Data

(63) Continuation-in-part of application No. 13/320,497, filed on Nov. 14, 2011, now Pat. No. 8,878,665, which is a continuation-in-part of application No. PCT/US2011/036233, filed on May 14, 2010.

(60) Provisional application No. 61/345,056, filed on May 14, 2010.

(51) Int. Cl.

| | |
|---|---|
| ***G08B 1/08*** | (2006.01) |
| ***G08B 25/06*** | (2006.01) |
| ***G08B 17/00*** | (2006.01) |
| ***G08B 17/10*** | (2006.01) |
| ***G08B 17/06*** | (2006.01) |

(52) U.S. Cl.

CPC ..... *G08B 25/06* (2013.01); *G08B 17/00* (2013.01); *G08B 17/06* (2013.01); *G08B 17/10* (2013.01)

(58) Field of Classification Search

CPC ..... G08B 1/08; G08B 17/00; G08B 17/06; G08B 17/10; G08B 21/02; G08B 21/18; G08B 25/06

See application file for complete search history.

(56) References Cited

U.S. PATENT DOCUMENTS

| | | | | |
|---|---|---|---|---|
| 2,567,908 A | | 9/1951 | Levy | |
| 4,611,204 A | | 9/1986 | Draayer | |
| 4,823,015 A | * | 4/1989 | Galvin ..... | G08B 29/145 250/338.1 |

(Continued)

OTHER PUBLICATIONS

The present application is a CIP of U.S. Appl. No. 13/320,497, which is a CIP of PCTUS2011/036233. This document 1 is by Australia IP, Australia government Patent Office Examination Report 1, re: a corresponding Australia national phase of said parent PCTUS2011/036233, Report date Jan. 24, 2014.

(Continued)

*Primary Examiner* — Ryan Sherwin
(74) *Attorney, Agent, or Firm* — Nolte Nolte & Hunter

(57) ABSTRACT

A fire alarm system includes a transceiver. The transceiver has: a housing; conductors for receiving power from power lines; power output conductors for transmitting the power to a local alarm; and a connector for the alarm conductor of the local alarm. The transceiver has a trigger circuit, responsive to an alarm condition. A transmitter circuit responds to the alarm condition by injecting a signal onto a power conductor, using power line carrier technology. A receiver circuit responds to a second signal, similar to the first signal, by triggering the transmitter circuit; and by triggering the local alarm.

2 Claims, 8 Drawing Sheets

(56) References Cited

U.S. PATENT DOCUMENTS

| | | | | |
|---|---|---|---|---|
| 4,827,247 | A * | 5/1989 | Giffone | G08B 29/145 250/574 |
| 4,956,875 | A | 9/1990 | Bernard et al. | |
| 5,168,262 | A | 12/1992 | Okayama | |
| 5,508,568 | A * | 4/1996 | Mammen | G08B 1/08 307/117 |
| 5,691,704 | A * | 11/1997 | Wong | G08B 17/10 340/628 |
| 5,999,094 | A | 12/1999 | Nilssen | |
| 6,611,204 | B2 | 8/2003 | Schmurr | |
| 6,778,082 | B2 | 8/2004 | Goodwin | |
| 6,788,198 | B2 | 9/2004 | Harshaw | |
| 6,822,555 | B2 * | 11/2004 | Mansfield, Jr. | G08B 25/06 340/538 |
| 7,301,455 | B2 | 11/2007 | McKenna et al. | |
| 7,403,096 | B2 | 7/2008 | Curran et al. | |
| 7,456,728 | B2 * | 11/2008 | Huang | G08B 17/10 340/286.05 |
| 8,910,820 | B2 * | 12/2014 | Sharpe | G08B 17/10 220/481 |
| 9,083,443 | B2 * | 7/2015 | Becker | G08B 25/06 |
| 2004/0097137 | A1 | 5/2004 | Devine et al. | |
| 2005/0156669 | A1 | 7/2005 | Ando | |
| 2006/0152356 | A1 * | 7/2006 | Yang | A62C 99/009 340/524 |

OTHER PUBLICATIONS

International Search Report of PCT/US2011/036233.

Written Opinion of the International Searching Authority, dated Feb. 9, 2012, and International Preliminary Report on Patentability, dated Nov. 20, 2012.

Notice of References in parent U.S. Appl. No. 13/320,497.

* cited by examiner

FIRE ALARM POWER LINE CARRIER COM-SYSTEM

PRIORITY

This application Continuation-In-Part of and takes priority and benefit from Ser. No. 13/320,497 filed Nov. 14, 2011 and all its parent applications, for any common subject matter, and is a continuation in part thereof for any new matter.

Ser. No. 13/320,497 is currently pending and allowed a Bypass Continuation-In-Part of, and takes priority and benefit under 35 USC111(a) from PCT Application: PCTUS2011/036233, filed May 12, 2011, pending, for any common subject matter, and is a continuation in part thereof for any new matter.

Said PCT application is a non-provisional bypass application, of and takes priority from U.S. Provisional Application 61/345,056, filed May 14, 2010, when the PCT Application was filed. The present application also takes priority, for any common subject matter.

The present application also takes priority, for any common subject matter, from said U.S. Provisional Application 61/345,056, filed May 14, 2010, through said PCT Application.

Those Applications are all hereby incorporated by reference.

FIELD

The present invention is a device, and a two-wire interconnection scheme, that serves as an adapter 4 to interconnect and activate numerous residential 120 VAC operated smoke alarms 5 without the addition of a third red electrical conductor wire 6 required to trigger the independent audio alert line at the local alarm drive A. The present invention includes methods of installing and operating such a device.

BACKGROUND OF THE INVENTION

Fire Codes for buildings in most States require that one and two story dwellings maintain and often upgrade the alarm systems by interconnecting their smoke alarms and CO detectors for simultaneous operation. After interconnection, when one alarm sensor detects a hazard at one end of the house, all other installed alarm sensors, even ones located at the other end of a house, as well as each bedroom, are energized simultaneously and begin to emit their alarm sound. (FIG. 3)

Alarm interconnection has been proven to give people more time to escape from a structural fire. That extra time results in the saving of lives and property in a far greater proportion than when interconnection is not used.

The conventional method of accomplishing the necessary interconnection is to install each device with a third electrical wire connection 6. Two wires, white 6W and black 6B, provide the commercial power, such as 120 VAC 60 Hz power in the United States, or other commercial power, such as 230 VAC 50 Hz found in other countries.

A third trigger wire, usually red, is normally strung between alarms and is employed for interconnecting the low voltage signal needed to activate the other alarms installed within the building. This is typically a standard 9 VDC. Most United States Building and Fire Codes require this form of alarm interconnection in all new construction. Property Maintenance Codes require existing homes to be upgraded in this manner when and where it is feasible. When a fire or CO alarm actuates, it shorts this 9 VDC to its yellow alarm wire, which is conductively connected to the structure's red alarm wire system.

THE PRESENT INVENTION

This present invention makes it possible for all existing homes to receive the enhanced safety benefit of interconnecting all alarms in a house, while eliminating the expensive burden and inconvenience of rewiring, while still complying with state and local codes regarding alarm systems.

DETAILED DESCRIPTION

Figure 2:
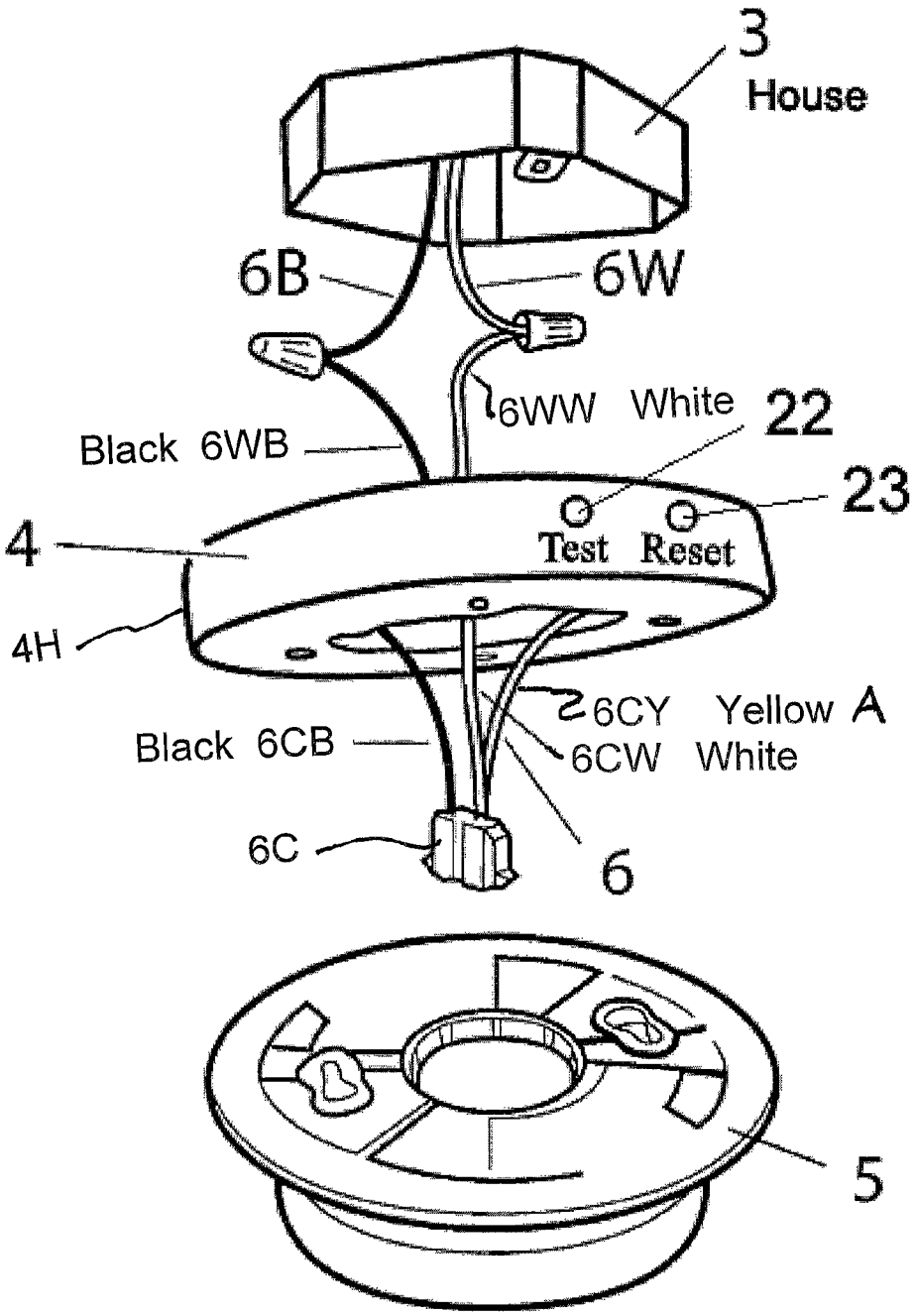
FIG. 2 is a perspective view of the present invention.

FIG. 2 shows that this present invention is a interface 4 also called in this application a transceiver 4, which simply mounts between:

an electrical receptacle 3 that supplies the structure's 120 VAC commercial power, and a local smoke alarm or CO detector 5 as in FIG. 2.

Other commercial power voltages will be preferred in various other countries.

The interface 4 comprises a 2-wire interconnected transceiver circuit, generally designated 4J, (FIG. 1) that uses power line carrier technology to inject an RF signal onto the two conductors: Black 6B and White 6W (FIG. 2), that deliver the commercial power.

Three wires feed from the alarm to the transceiver, which is part of the interface unit, whose exterior housing is shown as 4H in FIG. 2. From standardized connector 6C leads: a black AC power line 6CB; a white AC power line 6CW; ands a Yellow line 6CY, also shown in FIG. 1 as Yellow A, at the local alarm drive. The transceiver 4J (FIG. 1) comprises both a transmitter circuit 7 and a receiver circuit 9. The standard connectors 6C vary by smoke detector brand.

The transmitter portion 7 of the present invention is equipped with a trigger circuit 10 used to monitor the activity of output line Yellow A, usually a yellow wire Yellow A, of the local fire alarm sensor 5 it is attached to. When a low voltage (9 VDC) output signal is received on wire Yellow A (FIG. 1), from the red wire (FIG. 2) of a local fire alarm 5, the Radio Frequency (RF) transmitter 7 is activated, resulting in a Radio Frequency signal, preferably in this embodiment a sine wave of 455 KHz, being injected via wires 6B & 6W onto the 2 wire 120 VAC power lines 6W & 6B within the building for the purpose of activating any other fire alarm system transceiver 4 (FIGS. 2 & 3) attached to the same 120 VAC power lines anywhere within the same structure, and thereby sounding the local fire alarm 5.

Should the 455 KHz receiver portion 9 (FIG. 1) of the present invention detect the presence of a 455 KHz signal injected into the power lines 6W & 6B from any other fire alarm sensor 5 on the 120 VAC power line, it processes that signal through a state-of-the-art microprocessor 10A (FIG. 1) using specialized software for determining the validity of the alarm status. Such software can, for example, check the duration and or frequency of the alarm signal to make sure it's not a transient signal. When the validity of the alarm condition is confirmed, the microprocessor 10A (FIG. 1) activates the local fire alarm unit 5 (FIG. 2) attached to the present invention, and begins to emit the alarm sound through wire at Yellow A (FIG. 1) shown also as 6CY in FIG. 2.

This system allows as many alarms to be interconnected as desired. A smoke alarm and a carbon monoxide alarm could be in each room of as many rooms or zones as there are rooms or zones supplied by the commercial power circuit. If each alarm 5 were connected through an interface transceiver such as 4, all would be interconnected. All would alarm in response to an alarm from any one smoke, fire, or CO alarm.

A further feature of the present invention is to execute an "echo" transmission of the 455 KHz. signal, when a confirmed alert is detected from another alarm 5, so that it also acts as a 455 KHz. generator for the purpose of activating all other fire alarm units 5 attached to the building's 120 VAC power lines. This feature makes each transceiver 4 a repeater, and thereby increases the range of each alarm to every other alarm on the house circuit.

Figure 3:
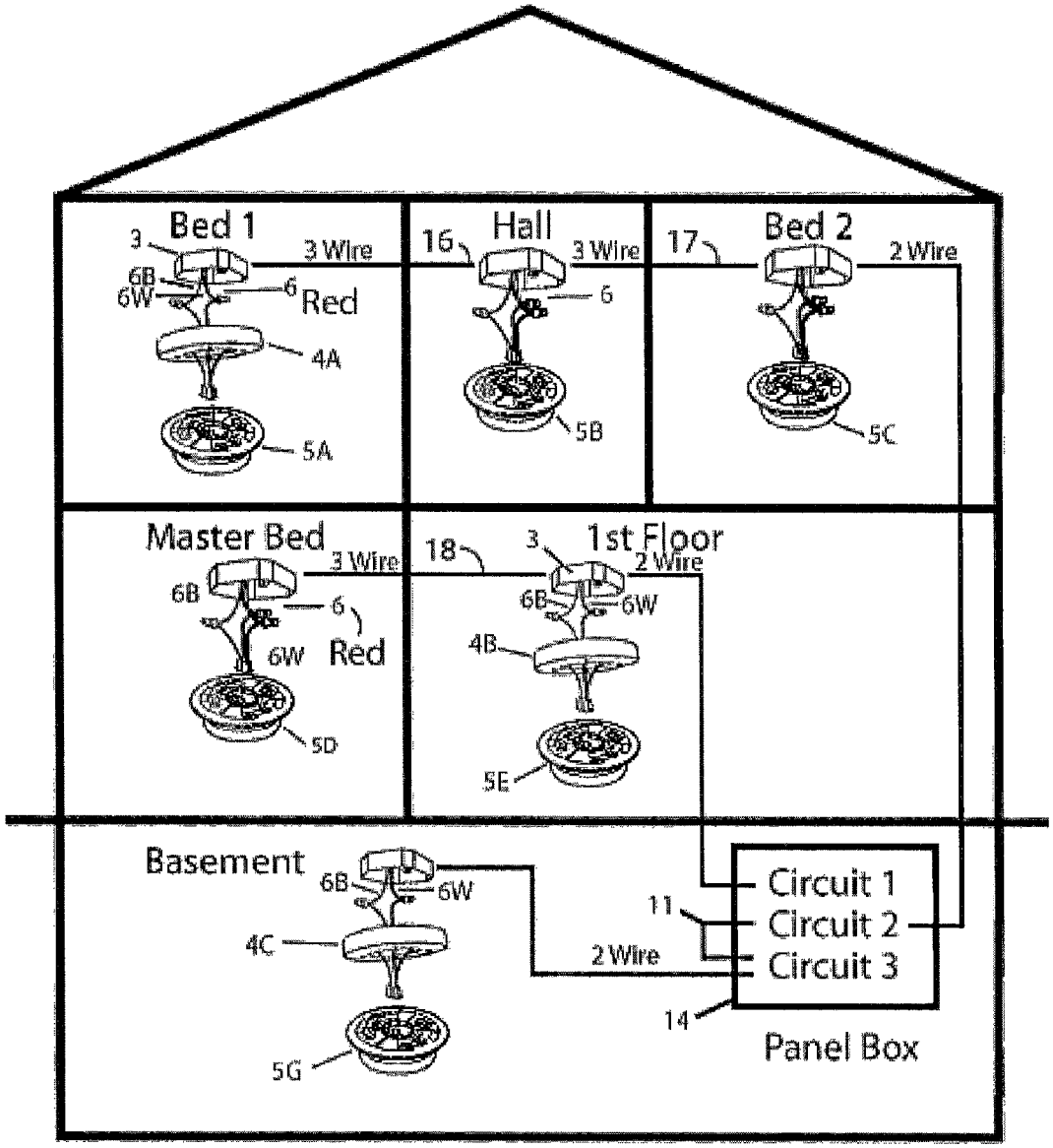
FIG. 3 is a block diagram showing use of three units of the invention in a dwelling.

As in FIG. 3, when there is a section of a house, such as:

Bed 1, Hall and Bed 2, that is already interconnected by a third conductor 6 Red, which is one of the three-wire conductors 16-17 therebetween, and additional smoke alarms such as 5D, 5E and 5G need to be interconnected to them, (FIG. 3) then, only one adapter, such as 4A, is needed to connect all the transceiver 4 equipped local alarms 5 such as 5A, 5E & 5G to the group (5G, 5B and 5C) that is pre-wired by three-wire conductors 16-17.

Similarly, transceiver 4B connects the three-wired conductor 18 group of:

1st Floor alarm 5D and Master Bed alarm 5E, to all the other in-house alarms 5A-5C & 5G.

Any further additional transceiver mounted alarms would also be thereby connected to the pre-existing interconnected alarm group through the group's transceiver 4B.

If:

two devices, such as 4A & 4B are used in a house; and they are not on the same phase, (e.g. Circuit 2 & Circuit 3) of the electrical supply; then a bridge circuit 11 must be installed between the two phases (Circuit 2 & Circuit 3) in the panel box 14.

Or, the installer can change the position of that particular circuit onto the same phase as the others, as by moving the 2 Wire from Circuit 3 to Circuit 2. He can usually do so at the circuit breaker panel box 14.

Thus, as many alarms can be interconnected in a structure, as there are existing commercial power supply points, without hiring a licensed electrician to run a new three-wire alarm circuit for each new local alarm 5.

Figure 1:
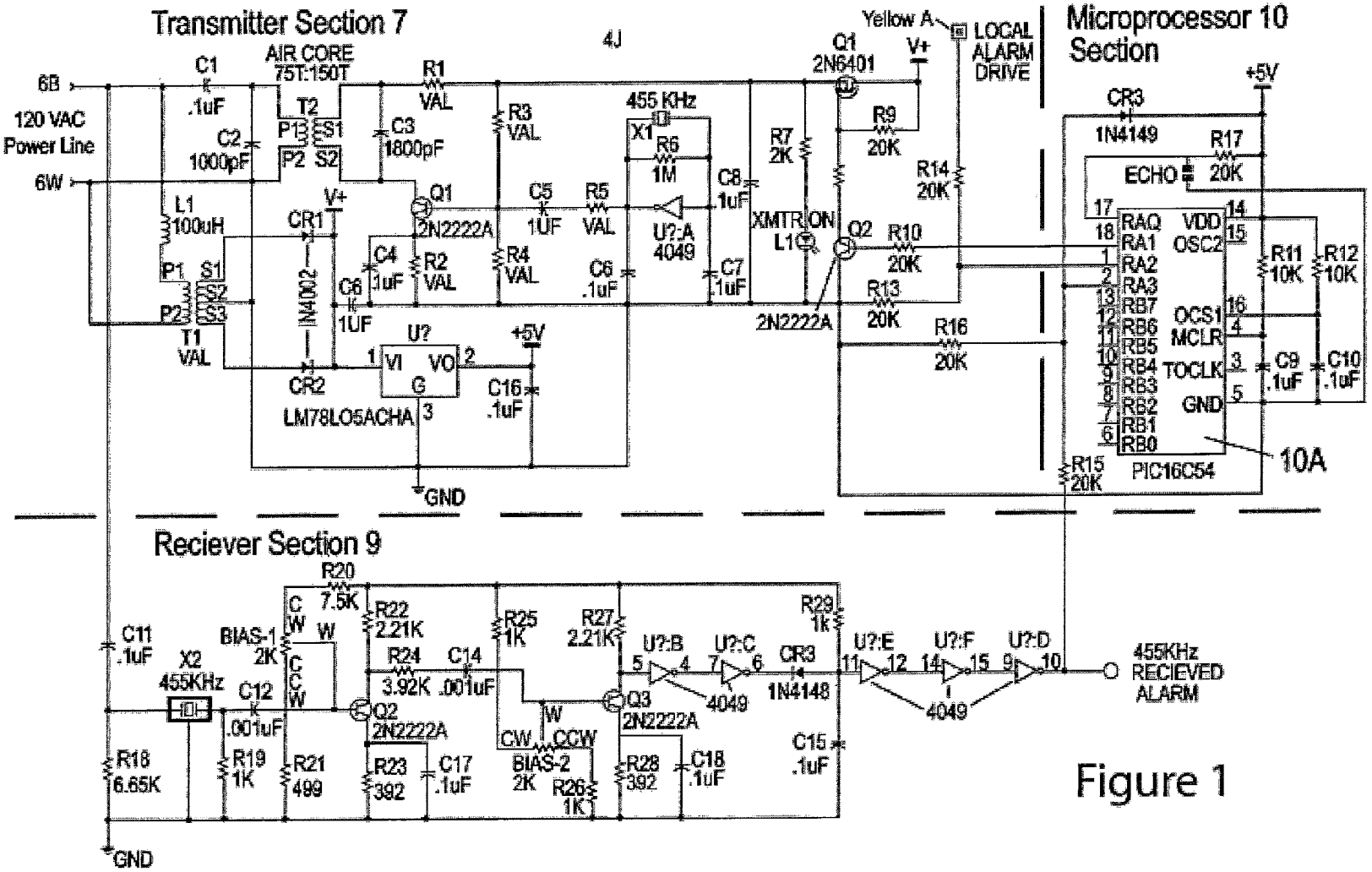
FIG. 1 is a circuit diagram of the present invention.
Figure 4:
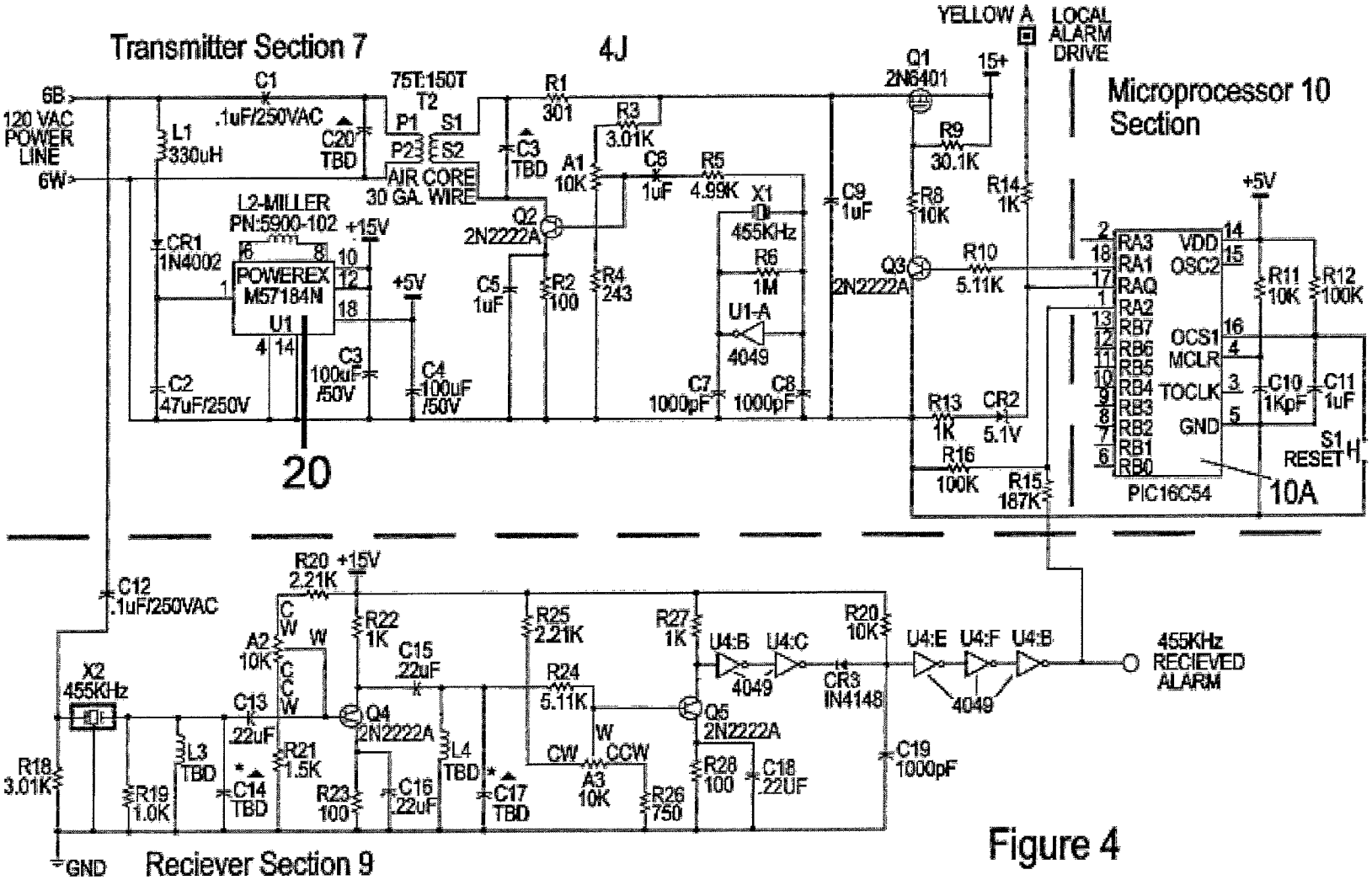
FIG. 4 is a circuit diagram of the present invention, similar to FIG. 1, with a modified power supply.

FIG. 4 is a circuit diagram, similar to FIG. 1. FIG. 4 shows another embodiment with a slightly different power supply 20, which is preferably a Powerex M57184N, in transmitter section 7. To further simplify installation, transceiver 4 can be equipped with an AC plug 60 FIG. 6, to plug directly into AC receptacles, where fire codes don't forbid such installations. This plug obviates the need to open boxes and twist wires. A disadvantage of a plug 60 is that, it may be easily unplugged, which would disable the alarm.

Figure 5:
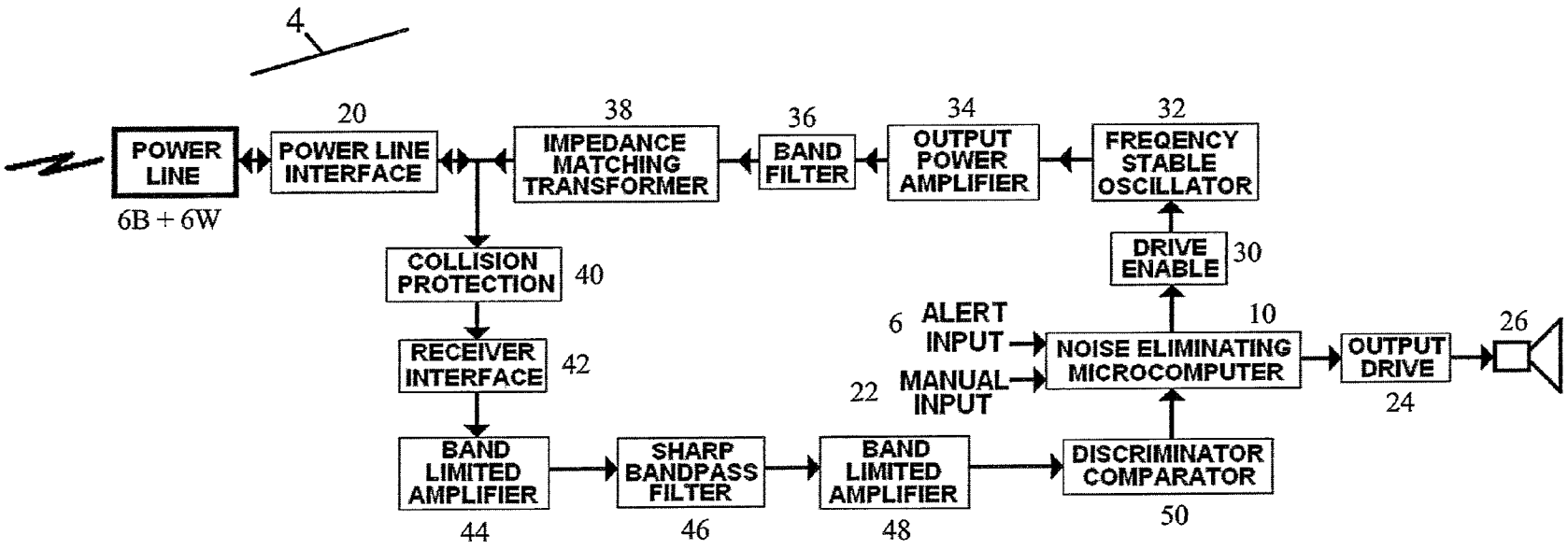
FIG. 5 is a block diagram of the elements of the transceiver 4.

FIG. 5 is a block diagram of the elements of the transceiver 4. Power is supplied through 110 Volt power wires 6B and 6W.

This power goes through a power line interface 20, which provides low voltage DC power to the transceiver 4.

When a 9 VDC alert input comes from detection of the smoke or CO alarm through wire 6; or when a manual input occurs through pressing:

the test button on the alarm 5, or an optional test button 22 (FIGS. 2, 6, 7, 8) on transceiver 4, then (FIG. 5) the signal is filtered through a noise eliminating micro computer 10.

If a test button 22 is provided, there should also be a reset button 23 (FIGS. 2, 6, 7, 8).

If, as in FIG. 5, the signal passes a screening test by the noise eliminating micro computer 10, then a 9 VDC alarm signal is sent through output drive 24, which actuates audible warning device 26.

Additionally drive enable 30 is stimulated to actuate frequency stable oscillator 32, which outputs a radio frequency wave, preferably in this embodiment 455 kHz, to output power amplifier 34, which amplifies that wave. We may find as the population of these alarms becomes dense, that it is helpful to provide an adjustable frequency or provide adjustably coded signals, to discriminate between interfering alarm signals. An adjustment control for adjustable frequency or adjustably coded signals is contemplated within the scope of this invention.

The radio frequency (RF) wave then passes through filter 36, through impedance matching transformer 38, and is injected through the powerline interface 20, into power lines 6B and 6W, for receipt by the other transceivers to actuate their alarms 26.

When another alarm such as 5A (FIG. 3) actuates its alarm, its transceiver 4 injects a similar radio frequency signal through its powerline interface 20, and through its powerlines 6B and 6W, into the electrical power circuit of the structure.

In FIG. 5, the power and RF enter circuit 4 through wires 6B and 6W (FIG. 5). The signal goes through power line interface 20.

The signal is filtered through collision protection 40, and if it passes that screening, to receiver interface 42.

A band limited amplifier 44 amplifies only a specific frequency used as the alarm frequency, preferably, in the presently preferred embodiment a frequency of about 455 kHz. Sharp band pass filter 46 further screens and narrows the frequency. This narrowed wave is then input into band limited amplifier 48 which amplifies it. The amplified wave is input to a discriminator comparator 50 which ascertains that the input signal is indeed 455 kHz, or whatever is the preferred frequency of this particular model.

The signal is passed from discriminator comparator 50 to noise eliminating microcomputer 10, and if it is determined not to be noise, a signal is sent to output drive 24 which actuates sound warning 26.

As part of the repeater feature the noise eliminating microcomputer 10 also passes the signal to drive enable 30, which actuates frequency stable oscillator 32 to output the 455 kHz signal, which is amplified by power amplifier 34. The amplified wave then passes through band filter 36 to further narrow it. The narrowed wave then passes through impedance matching transformer 38, and then to powerline interface 20, where the amplified signal is again injected into power lines 6B and 6W, for further transmission down the power line, to other alarms 4, which might otherwise be out of range of the unit which transmitted the original alarm signal to the unit 4 depicted in FIG. 5.

Figure 6:
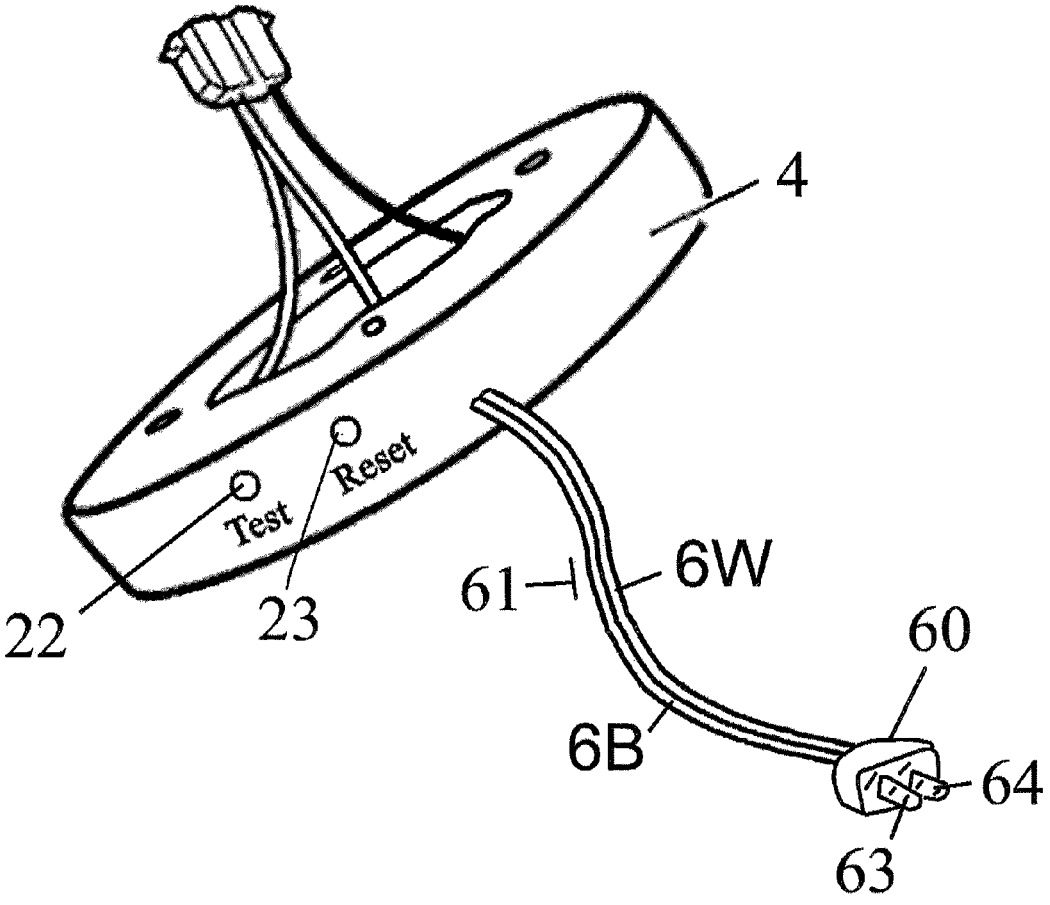
FIG. 6 is a perspective view of an alternate embodiment.

FIG. 6 shows an alternate embodiment of transceiver 4 comprising a two prong plug 60 at the end of power cord 61. Cord 61 comprises power wires 6B and 6W. A conventional two prong power plug 60 has a live prong 63 and a neutral prong 64. Plug 60 may be plugged into any standard 120 VAC electrical outlet. This makes it easy for the electrically inept to install transceivers 4, where they are not required by code to be permanently wired.

An optional test button 22 may be provided for an additional diagnostic tool, although the test button on the fire or CO alarm 5 can also test this part of the circuit. The advantage of the test button on unit 4 is that it allows the interface 4 to be tested independently of the detector 5.

A reset button 23 is a good way to terminate such a test, although the unit can alternately be designed to use a second press of Test 22 to terminate such a test.

Figure 7:
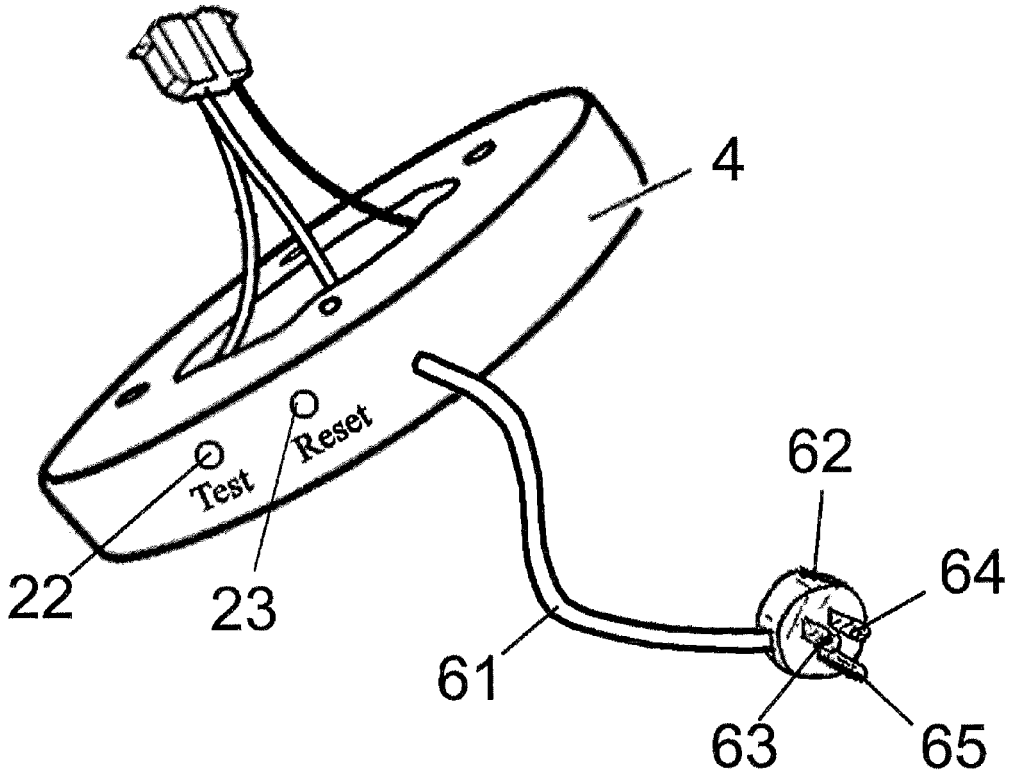
FIG. 7 is a perspective view of another alternate embodiment.

In FIG. 7, a three-prong power plug 62 is provided on three-conductor cord 61. A ground wire, in cord 61, connects ground prong 65 of plug 62.

Three prongs should not be necessary, since most fire alarms have two prong plugs. But in case some building code somewhere requires a ground prong 65, this configuration is envisioned as an alternative to an embodiment that has only two prongs 63 and 64.

Figure 8:
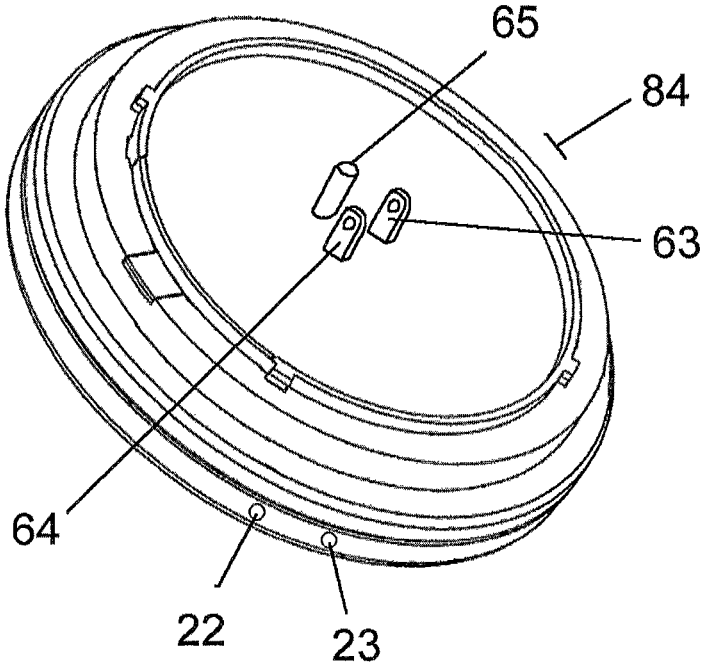
FIG. 8 is a perspective view of another alternate embodiment.

FIG. 8 shows a unit 84 in which the smoke detector or CO detector, or both, are integrated into the unit 84. Additionally an alternative power plug is shown having three prongs 63, 64 & 65 integrated onto the surface of the unit 84. This unit 84 can be mounted on a surface by plugging it 84 directly into a power receptacle in that surface. The friction of the prongs 63, 64 & 65 mounts unit 84 to the surface.

Alternatively, the integrated unit 84 may be equipped with a cord 60 and a plug 60 or 62, as shown in FIG. 6 or 7.

A "Test" switch 22 is important in this unit 84, because there is no separate alarm unit 5, providing its switches for testing. A reset switch 23 is nice to have too.

The invention claimed is:

1. A fire alarm system, in a structure having a pair of commercial power source conductors, said structure not fully wired with a dedicated alarm conductor, said fire alarm system comprising:

an alarm;

said alarm having an alarm conductor;

an interface (4) between the alarm and said commercial power source conductors;

said interface having two power output conductors;

said interface installed by:

disconnecting the alarm from the two commercial power source conductors that supply the alarm's power;

connecting the interface to the two commercial power source conductors;

connecting the alarm to the two power output conductors of the interface; and connecting the alarm conductor of the alarm to an alarm wire (6CY) of the interface; and a second interface, similarly installed between a second alarm and said commercial power source conductors;

each interface having:

a circuit (4J);

a pair of interface power input lines (6B, 6W), through which:

power, and a radio signal, as an RF (radio frequency) alarm signal, enter the circuit (4J);

a power line interface (20) through which the RF alarm signal goes;

a collision protector (40) through which the RF alarm signal is filtered, and a receiver interface (42), to which, if said RF alarm signal passes the collision protection, said RF alarm signal is transmitted;

a band limited amplifier (44), which amplifies only a specific frequency used as an alarm frequency of the RF alarm signal;

a sharp band pass filter (46), to further screen and narrow the frequency;

a band limited amplifier (48) which amplifies said RF alarm signal, a discriminator comparator (50), for input of the amplified said RF alarm signal, to ascertain that the input RF alarm signal is the specific frequency used as the alarm frequency;

a noise eliminating microcomputer (10), for:

processing the RF alarm signal from the discriminator comparator (50), ignoring noise, sending the RF alarm signal to an output drive (24), passing the RF alarm signal to a drive enable (30);

the drive enable (30), which actuates a frequency stable oscillator (32) to output the RF alarm signal;

the output drive (24), for actuating a sound warning (26);

a power amplifier (34) for amplifying the RF alarm signal;

a band filter (36) to further narrow the RF alarm signal;

an impedance matching transformer (38); and a power-line interface (20), where the RF alarm signal is injected into an interface power input line (6B, 6W).

2. A fire alarm system, according to claim 1, further comprising:

a third alarm interface, which might otherwise be out of range of a remote alarm interface which transmitted an original RF alarm signal to the circuit.

* * * * *